US012071823B2

(12) United States Patent
Wai et al.

(10) Patent No.: US 12,071,823 B2
(45) Date of Patent: Aug. 27, 2024

(54) DOWNHOLE ANCHOR SYSTEM

(71) Applicant: Halliburton Energy Services, Inc., Houston, TX (US)

(72) Inventors: Simon Whye Kwong Wai, Singapore (SG); Adriell Chuan Nan Phoe, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/190,197

(22) Filed: Mar. 27, 2023

(65) Prior Publication Data

US 2023/0349249 A1 Nov. 2, 2023

Related U.S. Application Data

(60) Provisional application No. 63/335,762, filed on Apr. 28, 2022.

(51) Int. Cl.
*E21B 23/01* (2006.01)

(52) U.S. Cl.
CPC ..... *E21B 23/01* (2013.01)

(58) Field of Classification Search
CPC ..... E21B 23/01
See application file for complete search history.

(56) References Cited

U.S. PATENT DOCUMENTS 2,812,821 A * 11/1957 Nelson ..... E21B 21/10 137/68.17
4,589,701 A * 5/1986 Beckmann ..... E21C 27/22 299/72
5,358,040 A * 10/1994 Kinley ..... E21B 17/1021 175/325.3
6,920,936 B2 7/2005 Sheiretov et al.
7,748,476 B2 7/2010 Krueger, V
9,447,648 B2 9/2016 Mitchell
(Continued)

FOREIGN PATENT DOCUMENTS

CN 107701118 A 2/2018
WO 2019194680 A1 10/2019

OTHER PUBLICATIONS

WIPO Written Opinion (Year: 2023).*

*Primary Examiner* — Steven A Macdonald
(74) *Attorney, Agent, or Firm* — John Wustenberg; Parker Justiss, P.C.

(57) ABSTRACT

Provided is an anchoring mechanism, a method for anchoring a downhole tool, and a well system. The anchoring mechanism, in one aspect, includes a tubular housing, a hub disposed about to the tubular housing, and a wedge hub disposed about the tubular housing, wherein at least one of the hub or wedge hub is slidably disposed about the tubular housing. The anchoring mechanism, according to this aspect, further includes one or more telescoping arms and one or more fixed toggle arms, wherein a first end of the one or more telescoping arms is coupled to one of the hub or the wedge hub, a first end of the one or more fixed toggle arms is coupled to an other of the wedge hub or the hub, and a second end of the one or more telescoping arms and a second end of the one or more fixed toggle arms are coupled to one another at a location between the first end of the one or more telescoping arms and the first end of the fixed toggle arms.

20 Claims, 10 Drawing Sheets

(56) References Cited

U.S. PATENT DOCUMENTS

| | | | | |
|---|---|---|---|---|
| 10,060,211 | B2 * | 8/2018 | Sonar | E21B 7/067 |
| 11,421,491 | B2 * | 8/2022 | Scruggs | E21B 23/0411 |
| 11,643,893 | B2 * | 5/2023 | Scruggs | E21B 23/01 166/298 |
| 11,649,687 | B1 * | 5/2023 | Dawson | E21B 17/1078 166/206 |
| 2003/0173076 | A1 | 9/2003 | Sheiretov et al. | |
| 2006/0180318 | A1 | 8/2006 | Doering et al. | |
| 2009/0071659 | A1 | 3/2009 | Spencer et al. | |
| 2013/0068479 | A1 * | 3/2013 | AlDossary | E21B 4/18 166/381 |
| 2016/0130895 | A1 * | 5/2016 | Sonar | E21B 7/067 175/230 |
| 2016/0298396 | A1 | 10/2016 | Church | |
| 2019/0078406 | A1 * | 3/2019 | Scruggs | E21B 23/042 |
| 2021/0262324 | A1 * | 8/2021 | Al Mulhem | E21B 23/02 |
| 2022/0325589 | A1 * | 10/2022 | Scruggs | E21B 23/042 |
| 2023/0417114 | A1 * | 12/2023 | Jaaskelainen | E21B 23/01 |

* cited by examiner

1000

DOWNHOLE ANCHOR SYSTEM

CROSS-REFERENCE TO RELATED APPLICATION

This application claims the benefit of U.S. Provisional Application Ser. No. 63/335,762, filed on Apr. 28, 2022, entitled "DOWNHOLE ANCHOR SYSTEM," commonly assigned with this application and incorporated herein by reference in its entirety.

BACKGROUND

Once an oil or gas well is drilled, it is often necessary for wireline logging tools, perforating devices, cutter tools, etc. to be lowered down the well with the use of a conveyance to perform logging, perforating, cutting, etc. operations.

To conduct these downhole operations, many tools require sufficiently high anchoring force to be generated. With the aid of anchoring devices, radial forces by the anchor pad generates enough friction against a wellbore to prevent sliding at the contact points between the anchor pad and the surface of the wall. Anchoring devices are usually designed to cater to a wide range of well-bore sizes, by radially expanding to accommodate the different pipe sizes during an operation. The current use of a toggle mechanism is a viable solution to most ranges of well-bore sizes. However, such a mechanism imposes a huge challenge when operations involve pipes with small diameters. The mechanical disadvantage arising from the use of a toggle mechanism causes the generation of insufficient anchoring forces, leading to operation failures.

Presently, there are alternative designs to cater to the limitations of a toggle anchor mechanism. One of such examples is based on the use of tapered surfaces known as wedges. This ensures that even at small pipe diameters, sufficiently high anchoring forces can still be achieved to carry out necessary operations. However, a key limitation to this design is the limited range of radial expansion.

BRIEF DESCRIPTION

Reference is now made to the following descriptions taken in conjunction with the accompanying drawings, in which.

DETAILED DESCRIPTION

Figure 1:
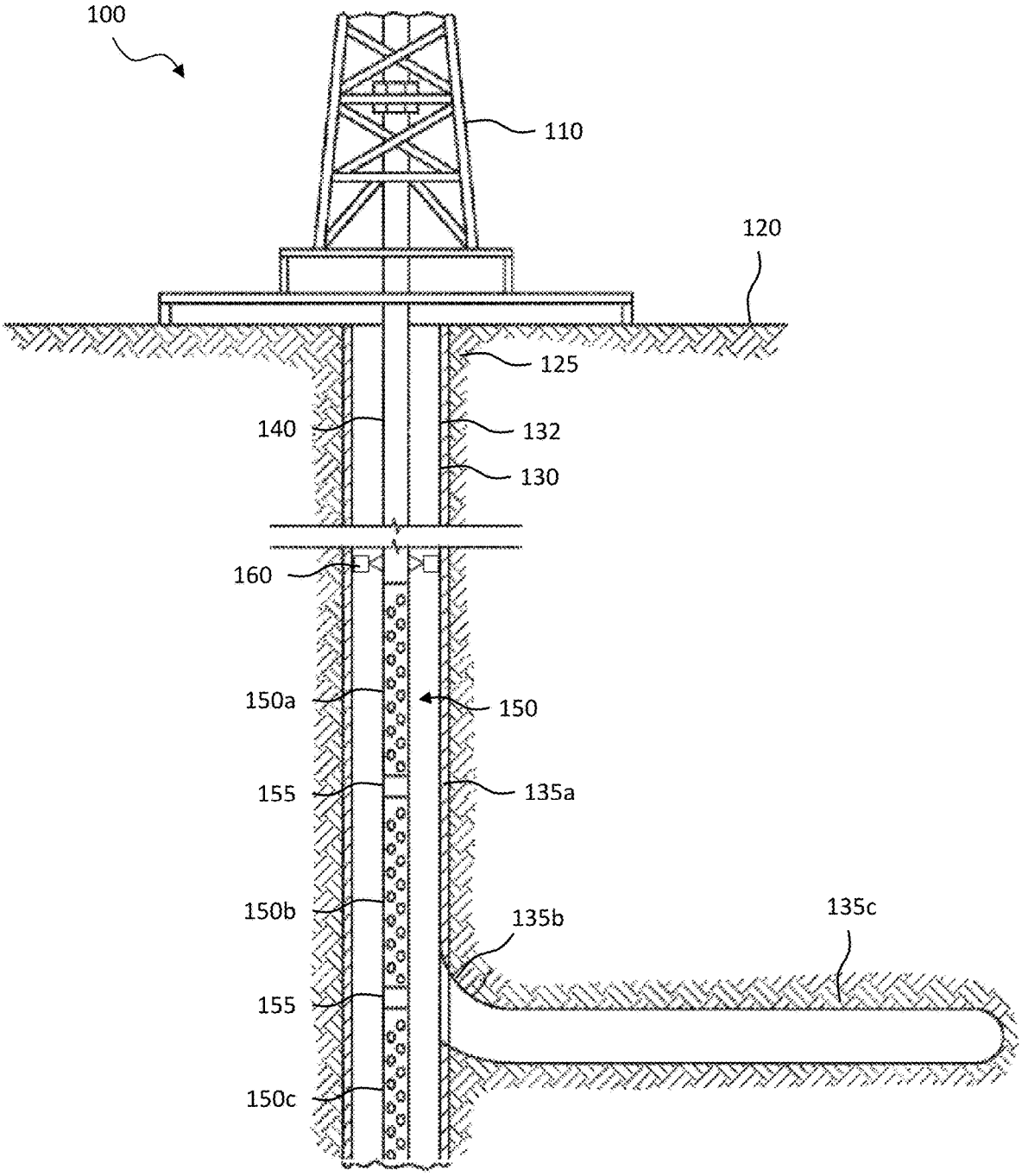
FIG. 1 illustrates a well system designed, manufactured, and operated according to one or more examples of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure is based, at least in part, on the recognition that traditional toggle based anchoring mechanisms and wedge based anchoring systems each have certain limitations that make them unsuitable for a variety of different wellbore sizes. Accordingly, the present disclosure has developed an improved anchoring mechanism that can provide sufficiently high radial output forces at all wellbore sizes. The present disclosure, in at least one embodiment, describes an anchoring mechanism that integrates the two different principles into one—the wedge and toggle mechanism. At small wellbore sizes, the mechanism adopts the wedge principle, whereby the vectored forces are imparted onto the anchor pad through the direct contact area between the wedge surface and the anchor pad. At larger wellbore sizes, a transition between the two principles occurs, and the toggle mechanism takes over the wedge mechanism. The vectored forces are then imparted on the anchor pad through the linkage arms. By combining the two principles, it is possible to achieve a substantially high radial force at all wellbore sizes, which is a major advantage of the present disclosure and is markedly better than existing counterparts.

In at least one embodiment, the tapered surface engages at (e.g., directly at) the anchor pad. Further to one embodiment of the disclosure, the disclosed anchoring mechanism employing the wedge principle is capable of expanding at least 130% from its fully radially retracted state to is fully radially extended state. In yet another embodiment, the disclosed anchoring mechanism employing the wedge principle is capable of expanding at least 150% from its fully radially retracted state to is fully radially extended state, if not at least 200%, or at least 250%.

FIG. 1 illustrates a well system 100 designed, manufactured, and operated according to one or more examples of the disclosure. As depicted, the well system 100 includes a workover and/or drilling rig 110 that is positioned above the earth's surface 120 and extends over and around a wellbore 130 that penetrates a subterranean formation 125 for the purpose of recovering hydrocarbons. The subterranean formation 125 may be located below exposed earth, as shown, as well as areas below earth covered by water, such as ocean or fresh water.

The wellbore 130 may be drilled into the subterranean formation 125 using any suitable drilling technique. In the example illustrated in FIG. 1, the wellbore 130 extends substantially vertically away from the earth's surface 120 over a vertical wellbore portion 135*a*, deviates from vertical relative to the earth's surface 120 over a deviated wellbore portion 135*b*, and transitions to a horizontal wellbore portion 135*c*. In alternative operating environments, all or portions of a wellbore may be vertical, deviated at any suitable angle, horizontal, and/or curved. The wellbore 130 may be a new wellbore, an existing wellbore, a straight wellbore, an extended reach wellbore, a sidetracked wellbore, a multi-lateral wellbore, and other types of wellbores for drilling and completing one or more production zones. Further, the wellbore 130 may be used for both producing wells and injection wells. In one or more examples, the wellbore 130 includes wellbore casing 132, which may be cemented into place in the wellbore 130.

A wellbore conveyance 140 may be lowered into the wellbore 130 for a variety of drilling, completion, workover, treatment, and/or production processes, amongst others, throughout the life of the wellbore 130. The example shown in FIG. 1 illustrates the wellbore conveyance 140 in the form of a completion assembly string disposed in the wellbore 130. It should be understood that the wellbore conveyance 140 is equally applicable to any type of wellbore conveyance being inserted into a wellbore 130, including as non-limiting examples drill pipe, casing, liners, jointed tubing, coiled tubing, wireline, slickline, etc. Further, the wellbore conveyance 140 may operate in any of the wellbore orientations (e.g., vertical, deviated, horizontal, and/or curved) and/or types described herein.

In an example, the wellbore conveyance 140 may include a completion assembly string comprising one or more wellbore tools, which may take various forms. For example, a zonal isolation device may be used to isolate the various zones within the wellbore 130 and may include, but is not limited to, a plug, a valve (e.g., lubricator valve, tubing retrievable safety valve, fluid loss valves, etc.), and/or a packer (e.g., production packer, gravel pack packer, frac-pac packer, etc.). Coupled to the wellbore conveyance 140, in the example illustrated in FIG. 1, is a perforating gun assembly 150 designed, manufactured and/or operated according to one or more examples of the disclosure. The perforating gun assembly 150 illustrated in FIG. 1 includes a first gun set 150*a*, a second gun set 150*b*, and a third gun set 150*c*, for example coupled to each other using one or more gun connector housings 155. While a perforating gun assembly has been illustrated at coupled to a downhole end of the wellbore conveyance 140, other embodiments may exist wherein a different downhole tool assembly is coupled to the downhole end of the wellbore conveyance 140. For instance, a wireline logging tool, a cutter tool (e.g., electromechanical cutter tool) or any other downhole tool assembly may be coupled to the downhole end of the wellbore conveyance 140. Accordingly, the present disclosure should not be limited to any specific downhole tool assembly.

In accordance with one embodiment of the disclosure, an anchoring mechanism 160 designed, manufactured and/or operated according to one or more embodiments of the disclosure, engages with the wellbore 130 (e.g., whether directly with the wellbore 130 or the wellbore casing 132). Accordingly, the anchoring mechanism 160 may be used to fix the downhole tool assembly (e.g., perforating gun assembly 150 in the embodiment of FIG. 1) at a desired location within the wellbore 130.

Figure 2:
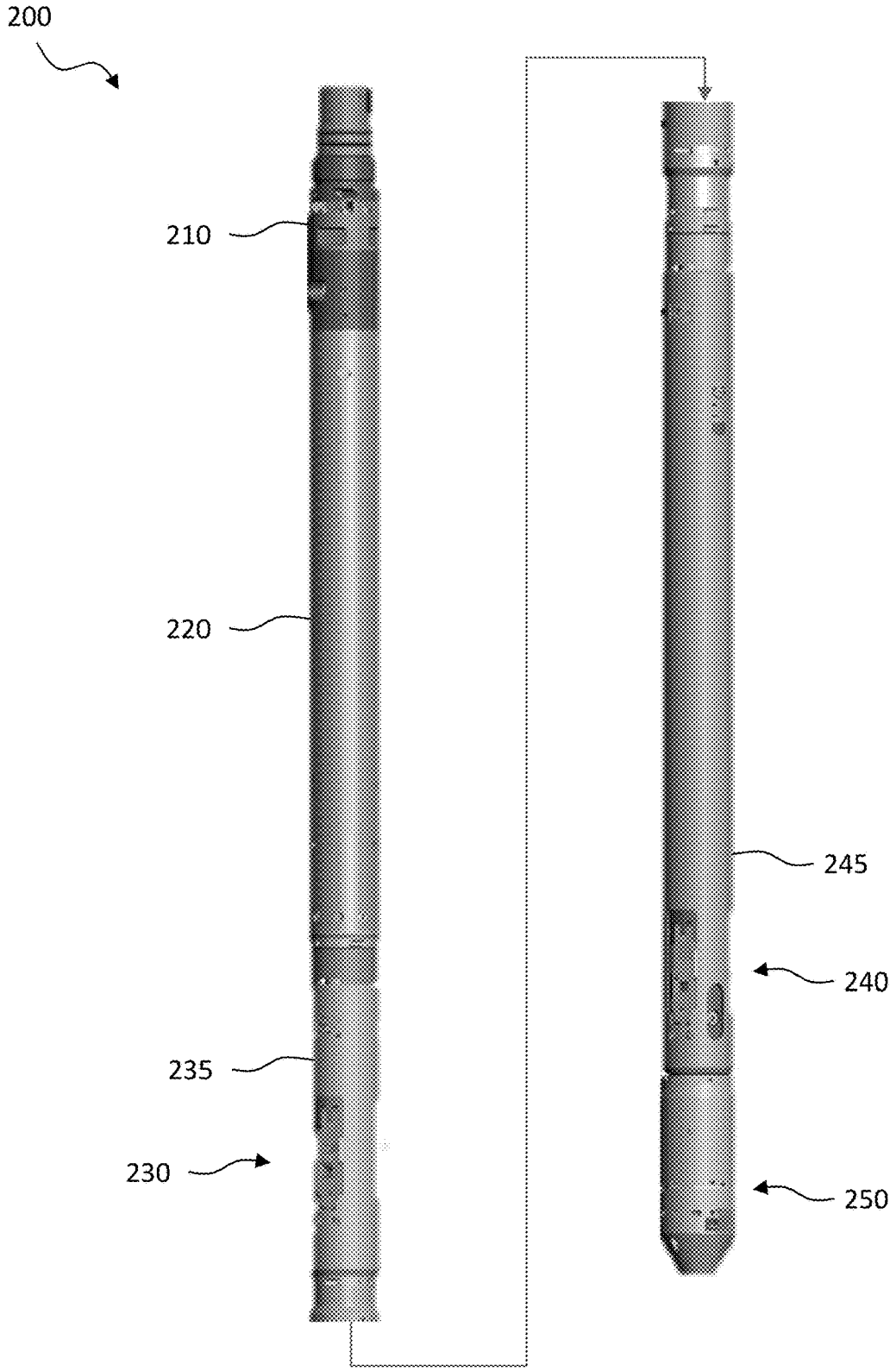
FIG. 2 illustrates one embodiment of a downhole tool designed, manufactured and/or operated according to one or more embodiments of the disclosure.

Turning to FIG. 2, illustrated is one embodiment of a downhole tool 200 designed, manufactured and/or operated according to one or more embodiments of the disclosure. The downhole tool 200, in at least one embodiment, is a tubing cutter. In accordance with this embodiment, the downhole tool 200 includes a field joint 210, a pressure activation housing 220 (e.g., for generating pressure to radially deploy the anchoring mechanism), a first anchoring mechanism 230 (e.g., including a first sliding sleeve 235 for activation thereof), an optional second anchoring mechanism 240 (e.g., including a second sliding sleeve 245 for activation thereof), and a cutting mechanism 250. While the embodiment of FIG. 2 is illustrated as a tubing cutter, an anchoring mechanism designed, manufactured and/or operated according to the disclosure could be used with any downhole tool.

Figure 3:
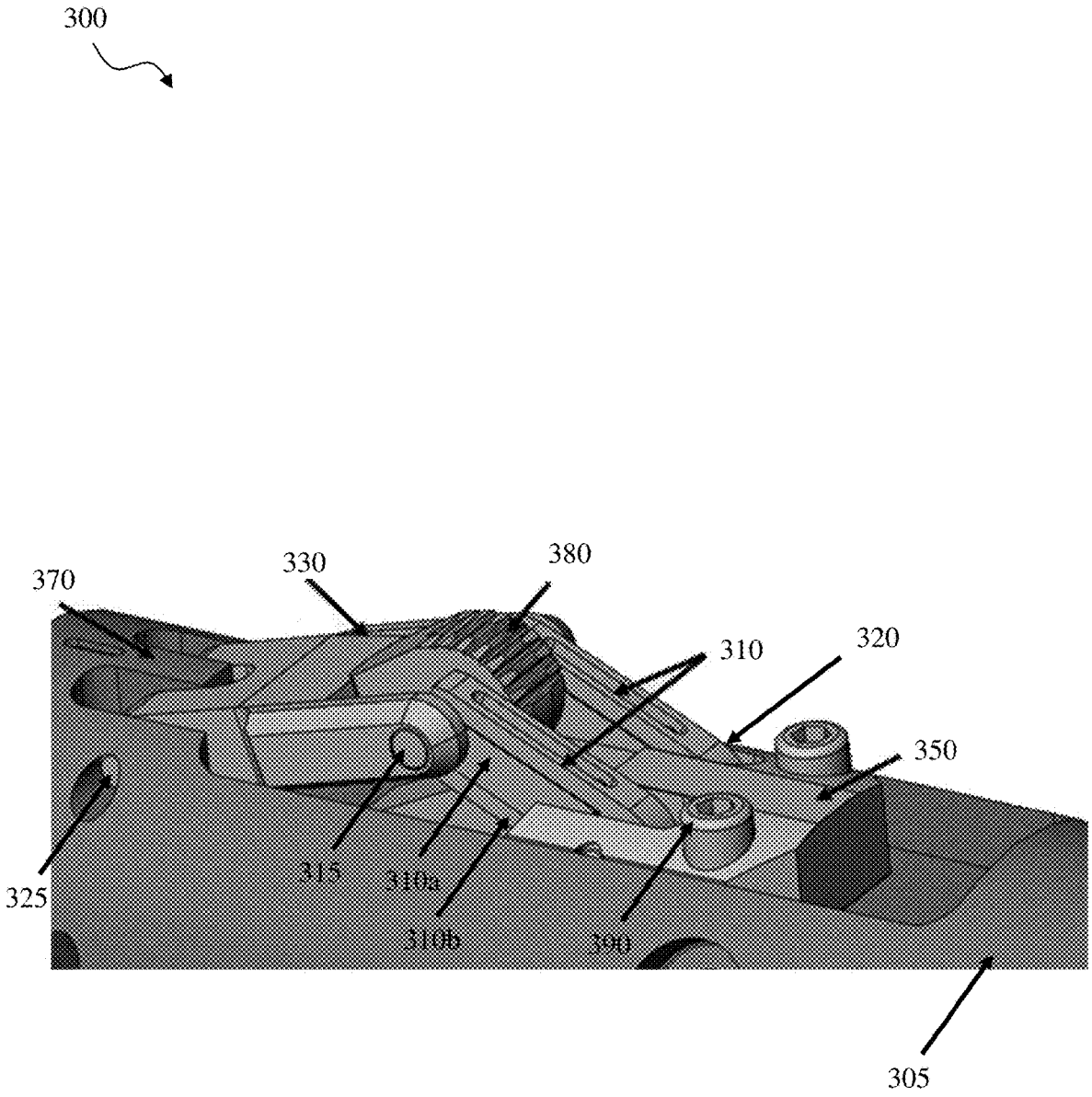
FIG. 3 illustrates an isometric view of one embodiment of an anchoring mechanism designed, manufactured and/or operated according to one or more embodiments of the disclosure.

Turning to FIG. 3, illustrated is an isometric view of one embodiment of an anchoring mechanism 300 designed, manufactured and/or operated according to one or more embodiments of the disclosure. In the illustrated embodiment, the anchoring mechanism 300 includes a tubular housing 305, one or more telescopic arms 310, one or more fixed toggle arms 330, a wedge hub 350 (e.g., slidable wedge hub, or fixed wedge hub), and a hub 370 (e.g., slidable hub or fixed hub). In accordance with one embodiment of the disclosure, at least one of the hub 370 and wedge hub 350 is configured to slide about the tubular housing 305. In the illustrated embodiment of FIG. 3, the wedge hub 350 is configured to slide while the hub 370 is fixed. It should be noted that the opposite could be true. In yet another embodiment, both the wedge hub 350 and the hub 370 are configured to slide relative to the tubular housing 305.

In at least one embodiment, a first end of the one or more telescoping arms 310 is coupled to one of the wedge hub 350 or the hub 370, a first end of the one or more fixed toggle arms 330 is coupled to the other of the hub 370 or the wedge hub 350, and a second end of the one or more telescoping arms 310 and a second end of the one or more fixed toggle arms 330 are coupled to one another between the first ends of the one or more telescoping arms 310 and fixed toggle arms 330. In the illustrated embodiment, each of the one or more telescopic arms 310 are connected to the one or more fixed toggle arms 330 by a first pivot point 315 (e.g., first pivot pin) on their second ends. The first ends of the one or more telescopic arms 310 are connected to the movable wedge hub 350 by a second pivot point 320 (e.g., second pivot pin). In contrast, the first ends of the one or more fixed toggle arms 330 are connected to the hub 370 by a third pivot point 325 (e.g., third pivot pin). Depending on the function of the anchoring mechanism, other elements, such as an anchor pad 380 can be joined at the first pivot point 315. Similarly, the anchoring mechanism 300 may have one or more connection points 390 (e.g., set screws) for physically coupling the wedge hub 350 to a source of an axial force (Fa), such as a sliding sleeve 395 (e.g., shown in FIG. 4).

In at least one embodiment, the one or more telescopic arms 310 include an inner member 310*a* and an outer member 310*b*, the inner and outer members 310*a*, 310*b* configured to slide (e.g., telescope) relative to one another. In the illustrated embodiment of FIG. 3, the inner member 310*a* is connected to the one or more fixed toggle arms 330 by the first pivot point 315, whereas the outer member 310*b* is connected to the movable wedge hub 350 by the second pivot point 320. In an alternative embodiment, the inner and outer members 310*a*, 310*b* could be swapped. Furthermore, in the illustrated embodiment, the one or more telescoping arms 310 are connected to the wedge hub 350 and the one or more fixed toggle arms 330 are connected to the hub 370. In an alternative embodiment, the one or more telescoping arms 310 could be connected to the hub 370 and the one or more fixed toggle arms 330 are connected to the wedge hub 350

Figure 4:
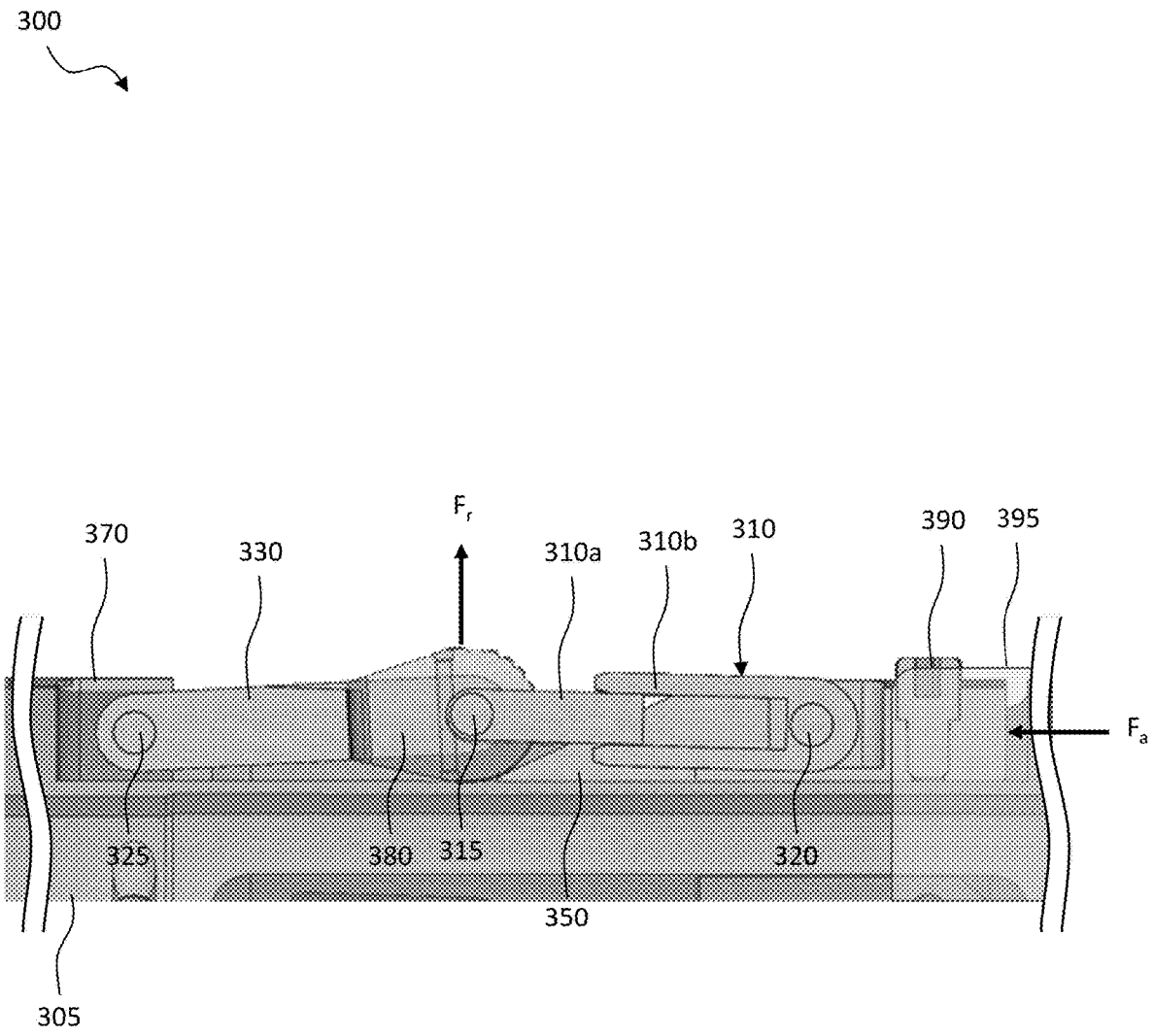
FIGS. 4-6 illustrate sectional views of various different operational implementations of the anchoring mechanism according to one embodiment of the disclosure.
Figure 5:
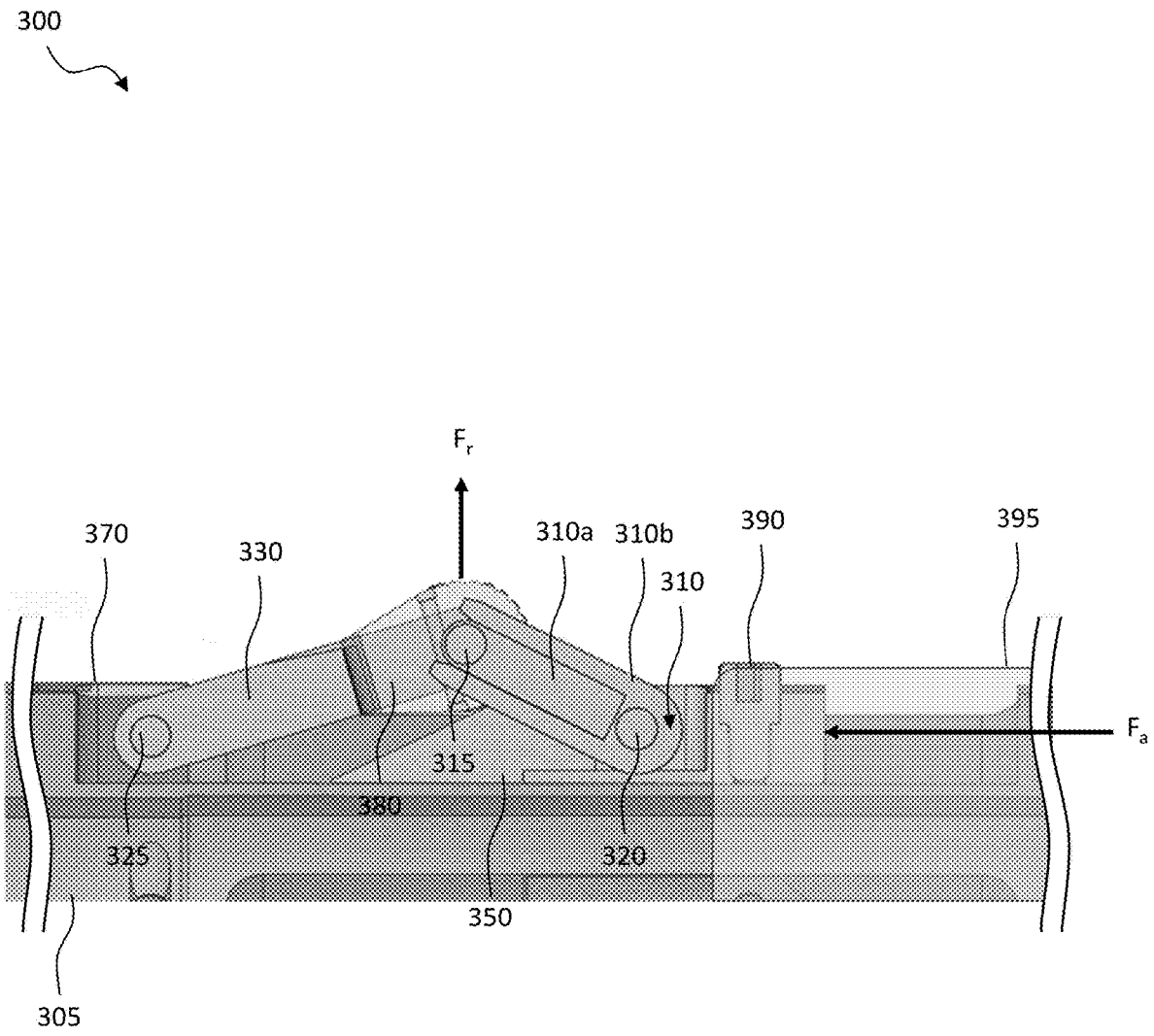
Figure 6:
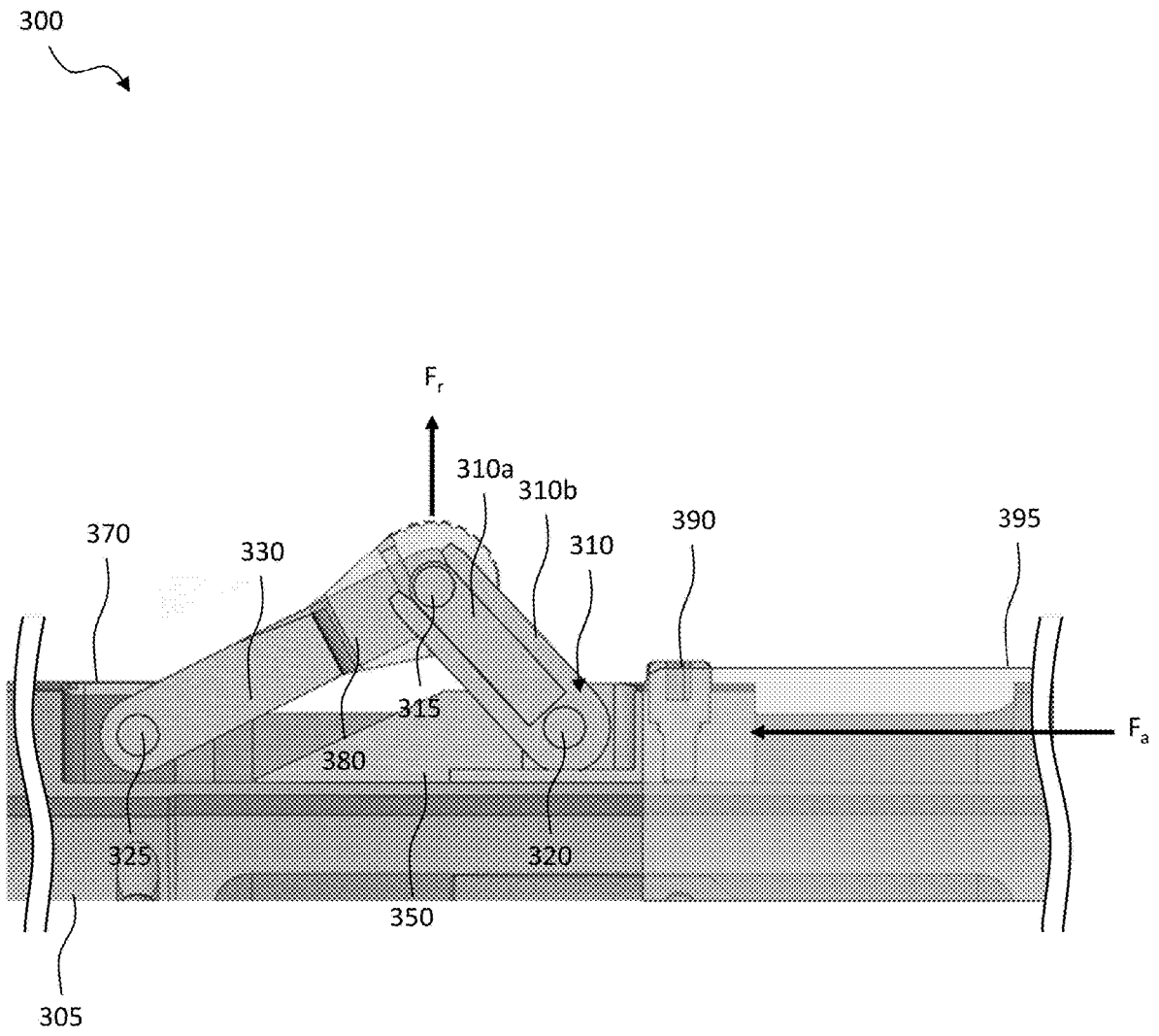

Turning now to FIGS. 4-6, illustrated are sectional views of various different operational implementations of the anchoring mechanism 300 according to one embodiment of the disclosure. FIGS. 4-6 illustrate the major elements of the anchoring mechanism 300, the principle of operation, and the various positions of the mechanism from a retracted state in FIG. 4, a partially extended state shown in FIG. 5, to a completely extended state shown in FIG. 6.

At the start of the stroke, as shown in FIG. 4, the anchor pad 380 is first engaged by the wedge hub 350. For example, in at least one embodiment the wedge hub 350 may engage a radially interior surface (e.g., directly engage a radially interior surface) of the anchor pad 380. In the illustrated embodiment, the one or more telescopic arms 310 are used to constrain the one or more fixed toggle arms 330 and anchor pad 380 in the radial position. As the wedge hub 350 gets displaced towards the center by an axial force ($F_a$), it causes the anchor pad 380 to slide along the inclined surface of the wedge hub 350, hence generating a force with a vector that is oriented in pushing the anchor pad 380 radially outward (e.g., upwards in the view shown).

As the stroke length continues to increase, the anchoring mechanism 300 will also continue to extend radially, causing the one or more telescopic arms 310 to decrease in length (e.g., causing the inner member 310*a* to slide within the outer member 310*b*). Once the anchor pad 380 contacts an inner surface that it is to engage (e.g., inner surface of the pipe, wellbore, etc.), axial forces ($F_a$) on the wedge hub 350 are transmitted through the contact line between the inclined surface and the anchor pad 380, and the upward force exerted by the anchor pad 380 on the surface of the inner surface acts as the anchoring force, ($F_r$) for the tool. It is important to note that the contact between the inclined surface and the anchor pad can be a point, line or area contact, depending on the design of the anchoring mechanism 300.

The maximum radial extension of the anchoring mechanism 300 using simply the wedge hub 350 is limited by the design constraints imposed on the anchoring mechanism 300. For example, depending on the stroke length, the size of the anchor pad 380, the length of the one or more telescopic arms 310 and one or more fixed toggle arms 330, and the angle and/or length of the inclined surface of the wedge hub 350, a maximum radial extension of the anchoring mechanism 300 using simply the wedge hub 350 is reached once the wedge hub 350 disengages from the anchor pad 380. At the same time, this engages the toggle feature, as illustrated in FIG. 5. The maximum radial extension of the anchoring mechanism 300 using simply the wedge hub 350 that the wedge mechanism can be used to achieve is said to occur at end of wedge stroke. During this stroke, a transition takes place between the wedge and the toggle mechanism.

As the stroke length continues to increase, the toggle mechanism becomes the principle of operation, as shown in FIG. 5. The axial force ($F_a$) applied on the wedge hub 350 is now transmitted through the one or more telescopic arms 310 onto the anchor pad 380. Once the anchor pad 380 contacts the inner surface that it is to engage (e.g., inner surface of the pipe, wellbore, etc.), the radial force ($F_r$) exerted by the anchor pad 380 on the surface acts as the anchoring force. The total maximum radial extension of the anchoring mechanism 300 using both the wedge hub 350 and the toggle mechanism is achieved once the anchoring mechanism reaches its end of stroke, and is typically at around, or prior to, the one or more telescoping arms 310 achieving a 45 degree angle (e.g., to prevent toggle lock).

Figure 7:
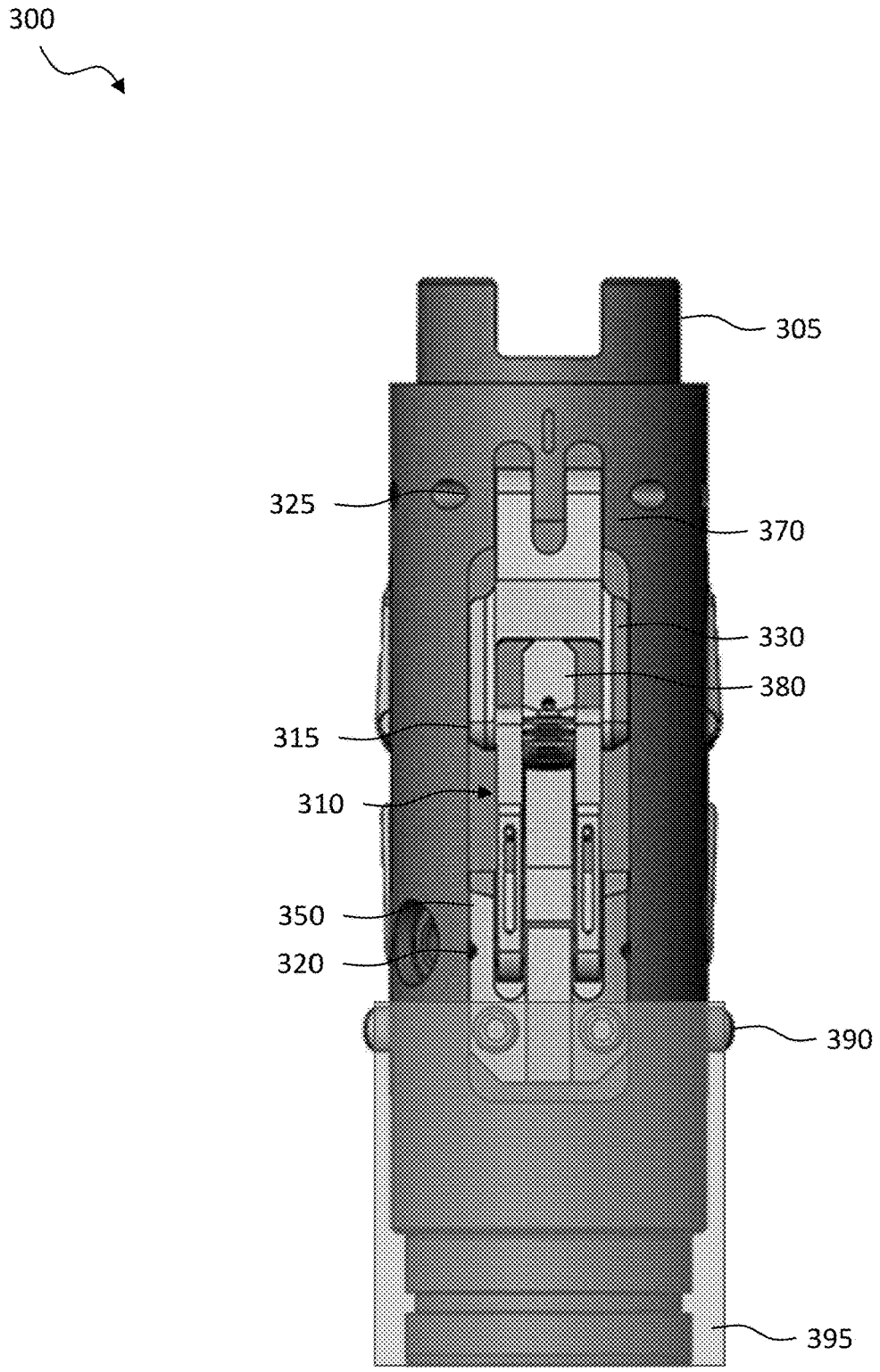
FIGS. 7-9 illustrate various different three-dimensional views of the anchoring mechanism, which is constructed using the same features discussed above.
Figure 8:
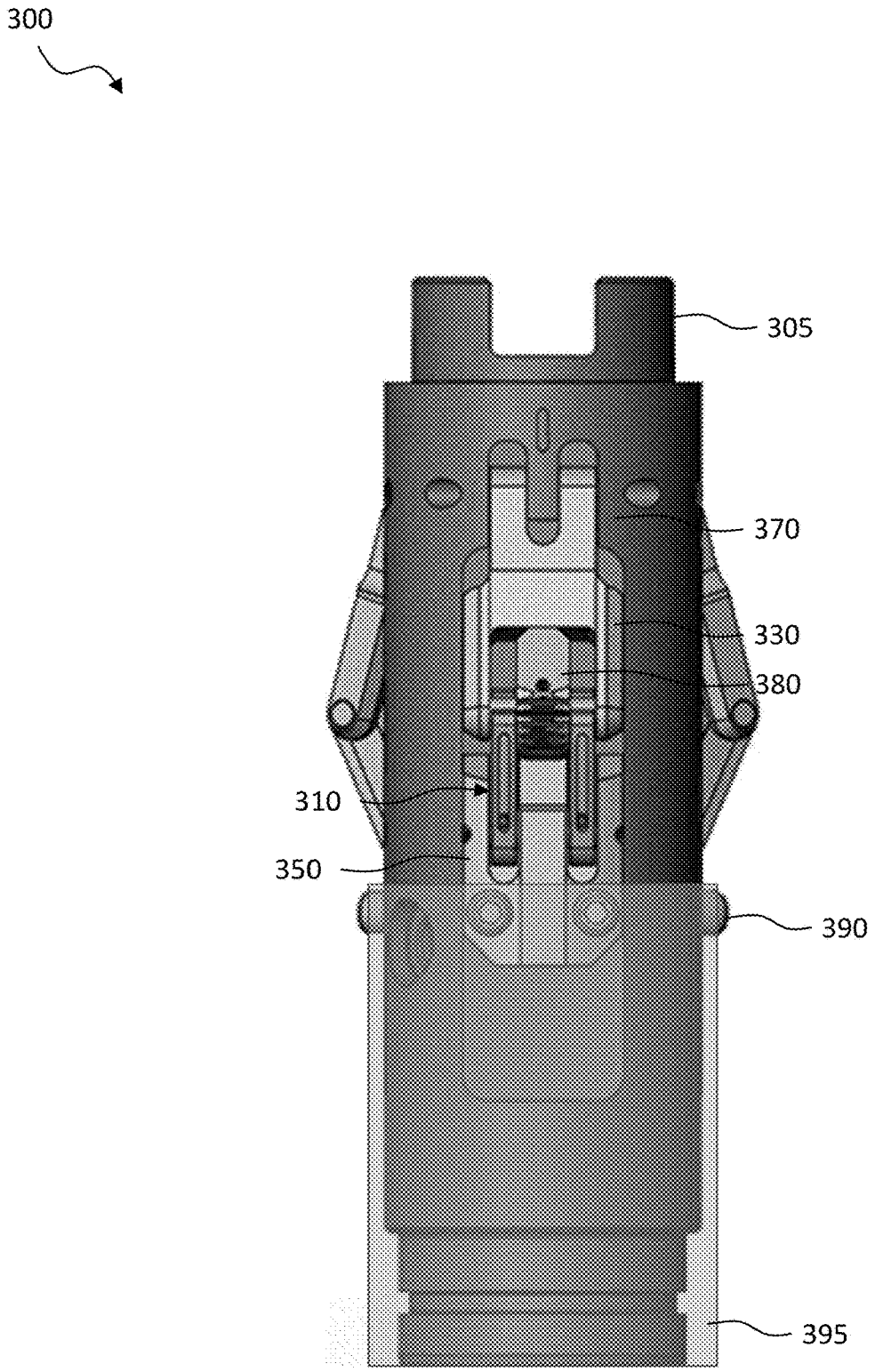
Figure 9:
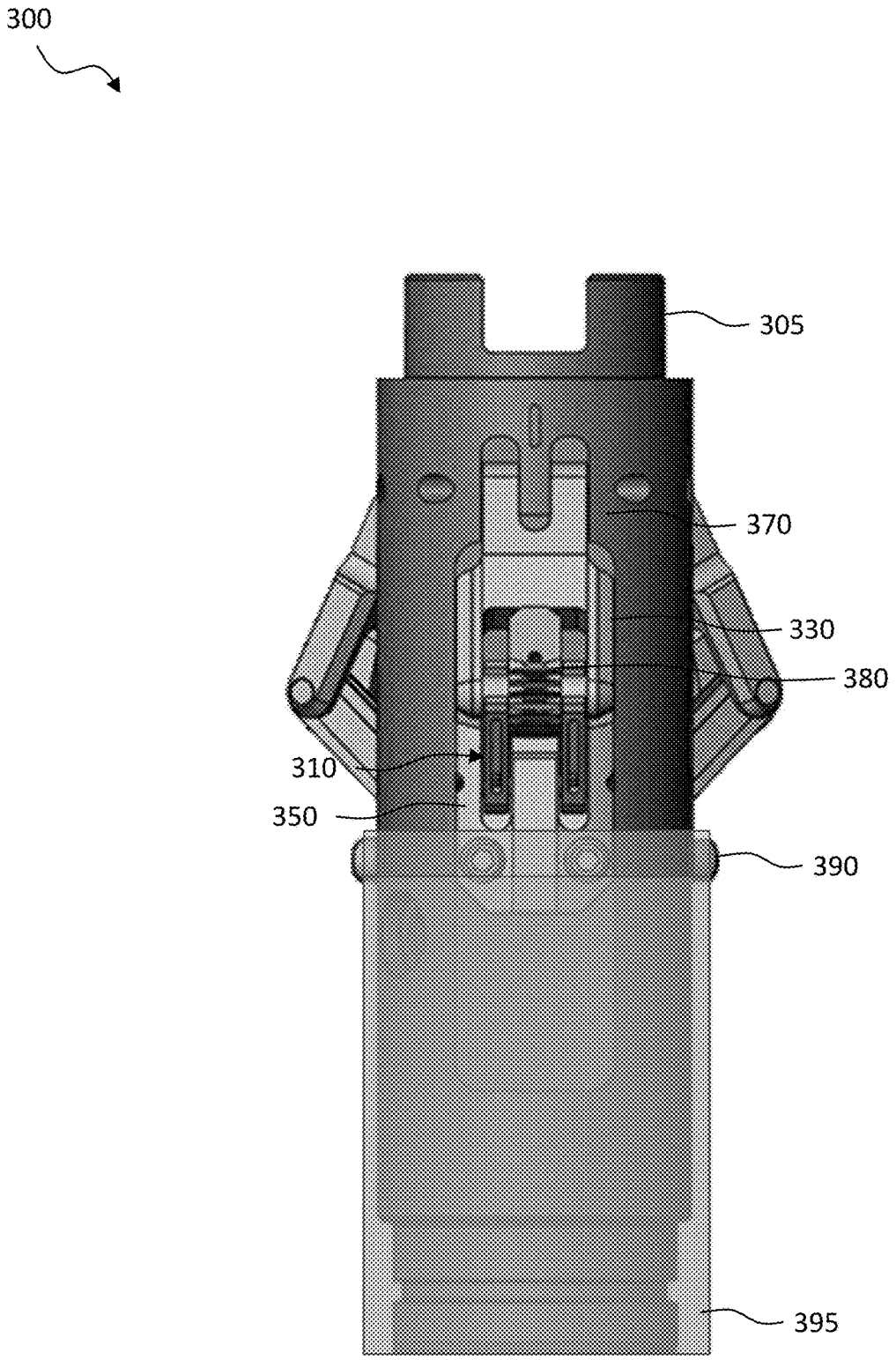

Turning to FIGS. 7-9, illustrated are various alternative views of the anchoring mechanism 300, which is constructed using the same features discussed above. In the illustrated embodiment, FIG. 7 is an alternative view of the anchoring mechanism 300 of FIG. 4 (e.g., retraced position), FIG. 8 is an alternative view of the anchoring mechanism 300 of FIG. 5 (e.g., partially extended position), and FIG. 9 is an alternative view of the anchoring mechanism 300 of FIG. 6 (e.g., fully extended position). As shown in FIGS. 7-9, the anchoring mechanism 300 includes two or more (e.g., three) symmetrical anchor systems which, like described in FIG. 3, may each include one or more telescopic arms 310, one or more fixed toggle arms 330, a movable wedge hub 350, and a hub 370.

Figure 10:
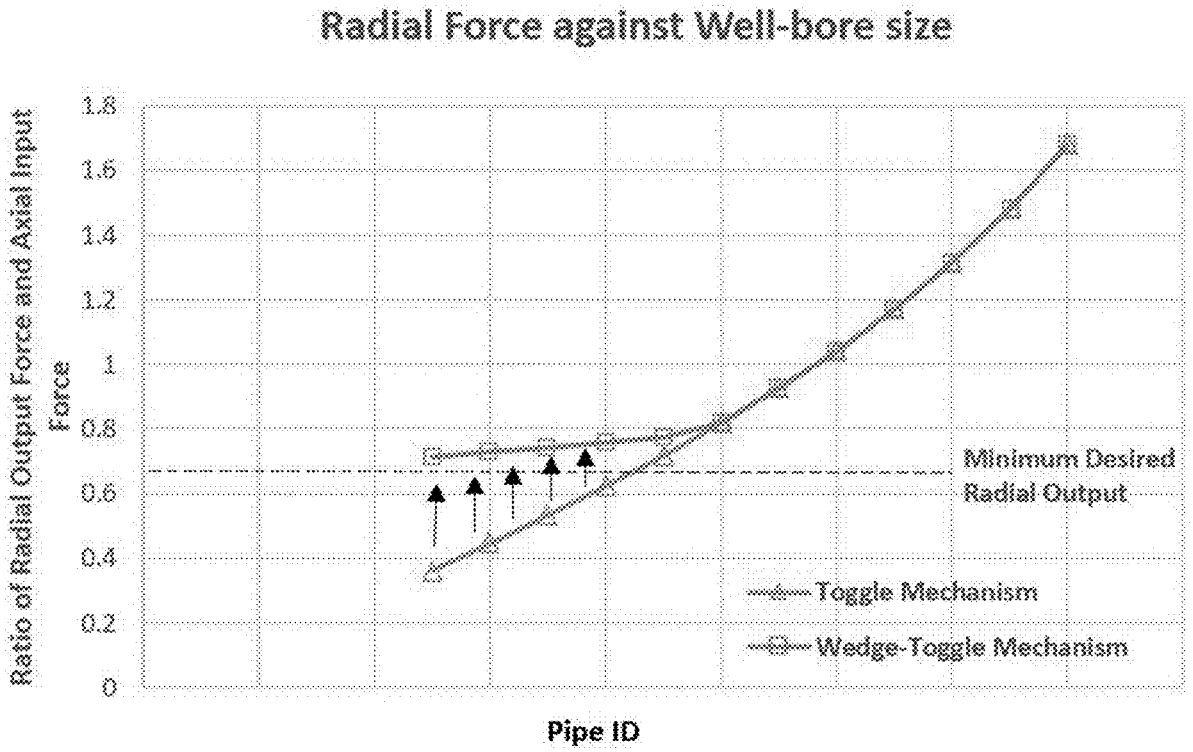
FIG. 10 illustrates a graph of the radial output force versus the well-bore size.

Turning now to FIG. 10, illustrated is a graph 1000 of the radial output force versus the well-bore size. The graph 1000 illustrates how the output radial force varies with increasing well-bore sizes per unit of input axial force. The exact magnitude and shape of the curve will depend on the design and dimensions of each of the major elements, hence, the illustration in FIG. 10 will show the general trendlines for each of the mechanism. This graph 1000 will suffice in presenting the key advantages of combining the wedge and toggle principles into a single mechanism. In FIG. 10, the curve indicated with triangles illustrates the magnitude of the radial output force when a unit of axial force is inputted for the toggle mechanism with no wedge. Notice that at small well-bore sizes, the toggle mechanism is severely mechanically disadvantaged, as depicted by the relatively small radial output force that can be generated by it. In contrast, when wedge mechanism is combined with the toggle, we see an upward shift in the curve at small well-bore sizes, as indicated with the curve with squares. This shows that with an anchoring mechanism designed, manufactured and/or operated according to one or more embodiments of the disclosure, the key disadvantage of the toggle mechanism has been effectively mitigated since a substantial amount of output force can still be generated at small well-bore sizes.

Aspects disclosed herein include:

A. An anchoring mechanism, the anchoring mechanism including: 1) a tubular housing; 2) a hub disposed about to the tubular housing; 3) a wedge hub disposed about the tubular housing, wherein at least one of the hub or wedge hub is slidably disposed about the tubular housing; and 4) one or more telescoping arms and one or more fixed toggle arms, wherein a first end of the one or more telescoping arms is coupled to one of the hub or the wedge hub, a first end of the one or more fixed toggle arms is coupled to an other of the wedge hub or the hub, and a second end of the one or more telescoping arms and a second end of the one or more fixed toggle arms are coupled to one another at a location between the first end of the one or more telescoping arms and the first end of the fixed toggle arms.

B. A method for anchoring a downhole tool, the method including: 1) providing an anchoring mechanism within a wellbore, the anchoring mechanism including: a) a tubular housing; b) a hub disposed about to the tubular housing; c) a wedge hub disposed about the tubular housing, wherein at least one of the hub or wedge hub is slidably disposed about the tubular housing; and d) one or more telescoping arms and one or more fixed toggle arms, wherein a first end of the one or more telescoping arms is coupled to one of the hub or the wedge hub, a first end of the one or more fixed toggle arms is coupled to an other of the wedge hub or the hub, and a second end of the one or more telescoping arms and a second end of the one or more fixed toggle arms are coupled to one another at a location between the first end of the one or more telescoping arms and the first end of the fixed toggle arms; and 2) sliding the hub or wedge hub to move the anchoring mechanism from a radially retracted state to a radially extended state.

C. A well system, the well system including: 1) a wellbore; and 2) a downhole tool disposed within the wellbore with a conveyance, the downhole tool including an anchoring mechanism, the anchoring mechanism including: a) a tubular housing; b) a hub disposed about to the tubular housing; c) a wedge hub disposed about the tubular housing, wherein at least one of the hub or wedge hub is slidably disposed about the tubular housing; and d) one or more telescoping arms and one or more fixed toggle arms, wherein a first end of the one or more telescoping arms is coupled to one of the hub or the wedge hub, a first end of the one or more fixed toggle arms is coupled to an other of the wedge hub or the hub, and a second end of the one or more telescoping arms and a second end of the one or more fixed toggle arms are coupled to one another at a location between the first end of the one or more telescoping arms and the first end of the fixed toggle arms.

Aspects A, B, and C may have one or more of the following additional elements in combination: Element 1: wherein the hub is a fixed hub. Element 2: wherein the wedge hub is slidably disposed about the tubular housing. Element 3: further including an anchor pad, wherein the second end of the one or more telescoping arms and the second end of the one or more fixed toggle arms are coupled to one another proximate the anchor pad, the anchor pad configured to engage an inner surface of a wellbore tubular. Element 4: wherein the wedge hub is configured to engage the anchor pad to move the anchor pad to a first radially extended state, wherein the wedge hub is configured to then disengage from the anchor pad and the one or more telescoping arms and one or more fixed toggle arms are configured to move the anchor pad to a second further radially extended state. Element 5: further including a sliding sleeve disposed about the tubular housing, the sliding sleeve coupled with the at least one of the hub or wedge hub slidably disposed about the tubular housing, the sliding sleeve configured to slide to move the anchor pad to the first radially extended state and the second further radially extended state. Element 6: further including one or more connection points for physically coupling the sliding sleeve with the at least one of the hub or wedge hub slidably disposed about the tubular housing. Element 7: wherein the one or more telescoping arms each include an inner member and an outer member, the inner and outer members configured to telescope relative to one another. Element 8: wherein the outer member is coupled to the one of the hub or the wedge hub slidably disposed about the tubular housing and the inner member is coupled to the fixed toggle arm. Element 9: wherein the hub is a fixed hub and the wedge hub is slidably disposed about the tubular housing. Element 10: further including an anchor pad, wherein the second end of the one or more telescoping arms and the second end of the one or more fixed toggle arms are coupled to one another proximate the anchor pad, the anchor pad configured to engage an inner surface of a wellbore tubular, and further wherein sliding the at least one of the hub or wedge hub about the tubular housing causes the anchor pad to engage an inner surface of the wellbore. Element 11: wherein the wedge hub is configured to engage the anchor pad to move the anchor pad to a first radially extended state, wherein the wedge hub is configured to then disengage from the anchor pad and the one or more telescoping arms and one or more fixed toggle arms are configured to move the anchor pad to a second further radially extended state. Element 12: further including a sliding sleeve disposed about the tubular housing, the sliding sleeve coupled with the at least one of the hub or wedge hub slidably disposed about the tubular housing, the sliding sleeve sliding to move the anchor pad to the first radially extended state and the second further radially extended state. Element 13: further including one or more connection points for physically coupling the sliding sleeve with the at least one of the hub or wedge hub slidably disposed about the tubular housing. Element 14: wherein the one or more telescoping arms each include an inner member and an outer member, the inner and outer members configured to telescope relative to one another. Element 15: wherein the outer member is coupled to the one of the hub or the wedge hub slidably disposed about the tubular housing and the inner member is coupled to the fixed toggle arm. Element 16: further including an anchor pad, wherein the second end of the one or more telescoping arms and the second end of the one or more fixed toggle arms are coupled to one another proximate the anchor pad, the anchor pad configured to engage an inner surface of a wellbore tubular. Element 17: wherein the wedge hub is configured to engage the anchor pad to move the anchor pad to a first radially extended state, wherein the wedge hub is configured to then disengage from the anchor pad and the one or more telescoping arms and one or more fixed toggle arms are configured to move the anchor pad to a second further radially extended state.

Those skilled in the art to which this application relates will appreciate that other and further additions, deletions, substitutions and modifications may be made to the described embodiments.

What is claimed is:

1. An anchoring mechanism, comprising:

a tubular housing;

a hub disposed about to the tubular housing;

a wedge hub disposed about the tubular housing, wherein at least one of the hub or wedge hub is slidably disposed about the tubular housing; and one or more telescoping arms and one or more fixed toggle arms, wherein a first end of the one or more telescoping arms is coupled to one of the hub or the wedge hub, a first end of the one or more fixed toggle arms is coupled to an other of the wedge hub or the hub, and a second end of the one or more telescoping arms and a second end of the one or more fixed toggle arms are coupled to one another at a location between the first end of the one or more telescoping arms and the first end of the fixed toggle arms.

2. The anchoring mechanism as recited in claim 1, wherein the hub is a fixed hub.

3. The anchoring mechanism as recited in claim 2, wherein the wedge hub is slidably disposed about the tubular housing.

4. The anchoring mechanism as recited in claim 1, further including an anchor pad, wherein the second end of the one or more telescoping arms and the second end of the one or more fixed toggle arms are coupled to one another proximate the anchor pad, the anchor pad configured to engage an inner surface of a wellbore tubular.

5. The anchoring mechanism as recited in claim 4, wherein the wedge hub is configured to engage the anchor pad to move the anchor pad to a first radially extended state, wherein the wedge hub is configured to then disengage from the anchor pad and the one or more telescoping arms and one or more fixed toggle arms are configured to move the anchor pad to a second further radially extended state.

6. The anchoring mechanism as recited in claim 5, further including a sliding sleeve disposed about the tubular housing, the sliding sleeve coupled with the at least one of the hub or wedge hub slidably disposed about the tubular housing, the sliding sleeve configured to slide to move the anchor pad to the first radially extended state and the second further radially extended state.

7. The anchoring mechanism as recited in claim 6, further including one or more connection points for physically coupling the sliding sleeve with the at least one of the hub or wedge hub slidably disposed about the tubular housing.

8. The anchoring mechanism as recited in claim 1, wherein the one or more telescoping arms each include an inner member and an outer member, the inner and outer members configured to telescope relative to one another.

9. The anchoring mechanism as recited in claim 8, wherein the outer member is coupled to the one of the hub or the wedge hub slidably disposed about the tubular housing and the inner member is coupled to the fixed toggle arm.

10. A method for anchoring a downhole tool, comprising:

providing an anchoring mechanism within a wellbore, the anchoring mechanism including:

a tubular housing;

a hub disposed about to the tubular housing;

a wedge hub disposed about the tubular housing, wherein at least one of the hub or wedge hub is slidably disposed about the tubular housing; and one or more telescoping arms and one or more fixed toggle arms, wherein a first end of the one or more telescoping arms is coupled to one of the hub or the wedge hub, a first end of the one or more fixed toggle arms is coupled to an other of the wedge hub or the hub, and a second end of the one or more telescoping arms and a second end of the one or more fixed toggle arms are coupled to one another at a location between the first end of the one or more telescoping arms and the first end of the fixed toggle arms; and sliding the hub or wedge hub to move the anchoring mechanism from a radially retracted state to a radially extended state.

11. The method as recited in claim 10, wherein the hub is a fixed hub and the wedge hub is slidably disposed about the tubular housing.

12. The method as recited in claim 10, further including an anchor pad, wherein the second end of the one or more telescoping arms and the second end of the one or more fixed toggle arms are coupled to one another proximate the anchor pad, the anchor pad configured to engage an inner surface of a wellbore tubular, and further wherein sliding the at least one of the hub or wedge hub about the tubular housing causes the anchor pad to engage an inner surface of the wellbore.

13. The method as recited in claim 12, wherein the wedge hub is configured to engage the anchor pad to move the anchor pad to a first radially extended state, wherein the wedge hub is configured to then disengage from the anchor pad and the one or more telescoping arms and one or more fixed toggle arms are configured to move the anchor pad to a second further radially extended state.

14. The method as recited in claim 13, further including a sliding sleeve disposed about the tubular housing, the sliding sleeve coupled with the at least one of the hub or wedge hub slidably disposed about the tubular housing, the sliding sleeve sliding to move the anchor pad to the first radially extended state and the second further radially extended state.

15. The method as recited in claim 14, further including one or more connection points for physically coupling the sliding sleeve with the at least one of the hub or wedge hub slidably disposed about the tubular housing.

16. The method as recited in claim 10, wherein the one or more telescoping arms each include an inner member and an outer member, the inner and outer members configured to telescope relative to one another.

17. The method as recited in claim 16, wherein the outer member is coupled to the one of the hub or the wedge hub slidably disposed about the tubular housing and the inner member is coupled to the fixed toggle arm.

18. A well system, comprising:

a wellbore; and a downhole tool disposed within the wellbore with a conveyance, the downhole tool including an anchoring mechanism, the anchoring mechanism including:

a tubular housing;

a hub disposed about to the tubular housing;

a wedge hub disposed about the tubular housing, wherein at least one of the hub or wedge hub is slidably disposed about the tubular housing; and one or more telescoping arms and one or more fixed toggle arms, wherein a first end of the one or more telescoping arms is coupled to one of the hub or the wedge hub, a first end of the one or more fixed toggle arms is coupled to an other of the wedge hub or the hub, and a second end of the one or more telescoping arms and a second end of the one or more fixed toggle arms are coupled to one another at a location between the first end of the one or more telescoping arms and the first end of the fixed toggle arms.

19. The well system as recited in claim 18, further including an anchor pad, wherein the second end of the one or more telescoping arms and the second end of the one or more fixed toggle arms are coupled to one another proximate the anchor pad, the anchor pad configured to engage an inner surface of a wellbore tubular.

20. The well system as recited in claim 19, wherein the wedge hub is configured to engage the anchor pad to move the anchor pad to a first radially extended state, wherein the wedge hub is configured to then disengage from the anchor pad and the one or more telescoping arms and one or more fixed toggle arms are configured to move the anchor pad to a second further radially extended state.

* * * * *